US011128048B2

(12) United States Patent
Morimoto et al.

(10) Patent No.: US 11,128,048 B2
(45) **Date of Patent: *Sep. 21, 2021**

(54) METHOD OF MANUFACTURING COIL COMPONENT AND JIG USED FOR MANUFACTURING THE COIL COMPONENT

(71) Applicant: SUMIDA CORPORATION, Tokyo (JP)

(72) Inventors: Yasunori Morimoto, Natori (JP); Yasuo Shimanuki, Natori (JP); Keiji Oyagi, Natori (JP); Masakazu Fukuoka, Natori (JP)

(73) Assignee: SUMIDA CORPORATION

( * ) Notice: Subject to any disclaimer, the term of this patent is extended or adjusted under 35 U.S.C. 154(b) by 213 days.

This patent is subject to a terminal disclaimer.

(21) Appl. No.: 16/391,749

(22) Filed: Apr. 23, 2019

(65) Prior Publication Data

US 2019/0252780 A1 Aug. 15, 2019

Related U.S. Application Data

(63) Continuation of application No. 15/083,607, filed on Mar. 29, 2016, now Pat. No. 10,312,592.

(30) Foreign Application Priority Data

Apr. 2, 2015 (JP) ..... 2015-076258

(51) Int. Cl.

| | |
|---|---|
| ***H01Q 7/00*** | (2006.01) |
| ***H01F 27/02*** | (2006.01) |
| ***H01F 41/00*** | (2006.01) |

(52) U.S. Cl.
CPC ..... *H01Q 7/00* (2013.01); *H01F 27/022* (2013.01); *H01F 41/005* (2013.01)

(58) Field of Classification Search
CPC ..... H01F 27/022; H01F 41/005; H01Q 7/00
See application file for complete search history.

(56) References Cited

U.S. PATENT DOCUMENTS 6,204,744 B1 3/2001 Shafer et al.
6,975,029 B2 12/2005 Horie
(Continued)

FOREIGN PATENT DOCUMENTS

EP 0217219 A1 4/1987
JP S561518 A 1/1981
(Continued)

OTHER PUBLICATIONS

First Chinese Office Action for Patent Application No. CN201610204094.3 dated Jun. 19, 2019 (17 pages).
(Continued)

*Primary Examiner* — Minh N Trinh
(74) *Attorney, Agent, or Firm* — Harness, Dickey & Pierce, P.L.C.

(57) ABSTRACT

A manufacturing method of a coil component including the steps of: holding a plurality of semi-finished products, each of which includes a base and a coil before forming the coil component, with a jig having a holding portion; setting the plurality of semi-finished products held by the jig to the setting positions of the jig in a mold; and sealing at least a portion within the base and the coil with resin by filling the resin into a cavity of the mold.

20 Claims, 13 Drawing Sheets

(56) References Cited

U.S. PATENT DOCUMENTS

| | | | | |
|---|---|---|---|---|
| 7,495,319 | B2 | 2/2009 | Fukuda et al. | |
| 8,872,621 | B2 | 10/2014 | Miura et al. | |
| 10,312,592 | B2 * | 6/2019 | Morimoto | H01F 27/022 |
| 2010/0134233 | A1 | 6/2010 | Wang et al. | |
| 2011/0128204 | A1 | 6/2011 | Murakami | |
| 2011/0260821 | A1 | 10/2011 | Yamada et al. | |
| 2012/0200388 | A1 | 8/2012 | Miura et al. | |
| 2012/0216392 | A1 | 8/2012 | Fan | |
| 2014/0292462 | A1 | 10/2014 | Lee | |
| 2015/0108627 | A1 | 4/2015 | Shimanuki et al. | |
| 2019/0252780 | A1 * | 8/2019 | Morimoto | H01Q 7/00 |

FOREIGN PATENT DOCUMENTS

| | | | |
|---|---|---|---|
| JP | S5683916 | A | 7/1981 |
| JP | H05-285977 | A | 11/1993 |
| JP | H06-069036 | A | 3/1994 |
| JP | H07-272964 | A | 10/1995 |
| JP | H10-289833 | A | 10/1998 |
| JP | 11-163009 | A | 6/1999 |
| WO | WO-2011-024559 | A1 | 3/2011 |

OTHER PUBLICATIONS

Extended European Search Report for EP Application No. 16163041.3, dated Aug. 22, 2016 (8 pages).

Office Action for Japanese Patent Application No. 2015-076258, dated Jan. 8, 2019 (5 pages).

* cited by examiner

METHOD OF MANUFACTURING COIL COMPONENT AND JIG USED FOR MANUFACTURING THE COIL COMPONENT

CROSS REFERENCE TO RELATED APPLICATIONS

This application is a continuation of U.S. patent application Ser. No. 15/083,607, filed Mar. 29, 2016, which claims priority to Japanese Patent Application No. 2015-76258 filed on Apr. 2, 2015, the contents of which are hereby expressly incorporated by reference herein in their entireties.

BACKGROUND OF THE INVENTION

Field of the Invention

The present invention relates to a method of manufacturing a coil component, and a jig used for manufacturing the coil component.

Description of the Related Art

As for a coil component using a coil, there exists a device carrying out transmission and reception of signals, for example, an automotive keyless entry system, an immobilizer, products in which IC tags are mounted, or the like. About such a coil component, there exists a technical disclosure in, for example, Patent Document 1 (Japanese PCT unexamined patent publication No. WO2011/024559). In the Patent Document 1, it is disclosed that a semiconductor substrate (IC chip) and lead terminals are connected by wires in an IC package and, that thereafter the circumference is sealed by a resin material to form the IC package.

In addition, about the technology by which the semiconductor chip is sealed by a resin, there exists a similar technical disclosure in Patent Document 2 (Japanese unexamined patent publication No. H11-163009) as that in the abovementioned Patent Document 1. In the Patent Document 2, there is a technical disclosure in which many semiconductor chips are installed on a lead frame or on a wiring board and thereafter, the plurality of semiconductor chips are resin-sealed simultaneously by a transfer-molding.

SUMMARY OF THE INVENTION

Meanwhile, in a case of manufacturing a coil component including a resin-sealed portion such as shown in the Patent Document 1, in the present circumstances, the manufacturing is often carried out by resin-sealing a large number of electronic components according to the transfer-molding as disclosed in the Patent Document 2. In such a manufacturing method, there is often employed a technique in which a large number of electronic components are installed on a plate which is a plate-shaped mother metal portion. After some processes such as welding and the like which are applied to the electronic component thereof, the plate is cut-off finally. In that case, it becomes a situation in which there are many uselessly thrown-away portions.

In a case of employing the technique in which the plate is cut-off at the end, the adjacent semi-finished product becomes an obstacle for winding the wire when wire-winding is applied to a rod-shaped core to form a coil before that cutoff, so that it is difficult to carry out the coil formation. To carry out the wire winding, it is necessary to use a special wire-winding machine in which the part carrying out the wire-winding rotates or the like, and concurrently, it is necessary to widen the space between the adjacent rod-shaped cores, and in that case, uselessly thrown-away portions of the plate will increase. In addition, the cost will become higher because of the cost of the special wire-winding machine.

On the other hand, it sometimes happens that there is employed such a technique in which at the first stage, a large number of semi-finished products are cut-out from the plate. In this case, although the wire-winding onto the rod-shaped core becomes easy to carry out, it is necessary to carry out the other processes individually for every semi-finished product and, therefore, handling such as the movement, the installation or the like of the semi-finished products between/in those respective processes requires more time. For example, when a transfer-molding is carried out by using a mold, it is necessary to set a large number of semi-finished products at desired positions of the mold respectively and, in addition, it is necessary also to take out the individual mold bodies after the molding by the mold.

The present invention was invented in view of such a problem and is addressed to providing a method of manufacturing a coil component, and a jig used for manufacturing the coil component, in which the handling of the semi-finished products during the respective processes can be made easy.

According to a first aspect of the present invention, there is provided a manufacturing method of a coil component comprising the steps of: holding a plurality of semi-finished products, each of which includes a base and a coil before forming the coil component, with a jig having a holding portion; setting the plurality of semi-finished products held by the jig to the setting positions of the jig in a mold; and sealing at least a portion within the base and the coil with resin by filling the resin into a cavity of the mold.

In the above-mentioned manufacturing method, an advantage may be obtained in the event that, in the step of sealing, a portion of a metal-made lead frame provided in the semi-finished product is sandwiched and held by the mold, and while setting the base and the coil of the semi-finished product held by the jig in the cavity of the mold, the portion on the outside of the portion where the lead frame is sandwiched and held by the mold, and the jig, are arranged on the outside of the cavity.

Further, in the above-mentioned manufacturing method an advantage may be obtained in the case that, in the step of sealing, the step is carried out by using a mold for transfer-molding.

Further, in the above-mentioned manufacturing method an advantage may be obtained by further including the steps of: installing a semiconductor substrate at a resin frame on the base prior to the step of setting; connecting terminal-ends of the coil and the semiconductor substrate electrically prior to the step of setting and after the step of installing, wherein these steps of installing and connecting are employed after the step of holding the plurality of semi-finished products with the jig.

In addition, in the above-mentioned manufacturing method an advantage may be obtained in the case that transportation between the step of installing and the step of connecting and transportation between the step of connecting and the step of setting are carried out by using the jig.

Further, in the above-mentioned manufacturing method an advantage may be obtained in the case that there is employed at least one of the steps of: forming the coil by winding a conductive wire, assembling the base and the coil to form the semi-finished product, removing a resin burr, which occurs at the mold-product during the step of sealing, after the step of sealing, and cutting-off the lead frame after the step of removing.

In addition, in the above-mentioned manufacturing method, an advantage may be obtained in the case that the jig is provided with a lower jig and an upper jig, and concurrently, in the step of holding, the semi-finished product is sandwiched between the lower jig and the upper jig.

Further, in the above-mentioned manufacturing method, an advantage may be obtained in the case that at least after the step of sealing is finished, the residual other than the semi-finished product is removed from the jig.

According to a second aspect of the present invention, there is provided a jig used for manufacturing a coil component, wherein the jig includes a holding portion which can hold a plurality of semi-finished products, each of which includes a base and a coil before forming the coil component, on the holding portion, the plurality of semi-finished products being held at an interval of a predetermined pitch between each other, and concurrently, the holding portion is configured to hold a portion of a metal-made lead frame which is provided to the semi-finished product in such a manner that, from the holding portion, the base and the coil protrude from the jig.

According to the present invention, it is possible to provide a method of manufacturing a coil component, and a jig used for manufacturing the coil component, in which the handling of the semi-finished products during the respective processes can be made easier.

BRIEF DESCRIPTION OF THE DRAWINGS

FIGS. 6A and 6B are views showing aspects of a support unit and a solder layer 45 before and after a reflow, in which FIG. 6A shows a state before the reflow and FIG. 6B shows a state after the reflow;

FIGS. 7A and 7B relate to a modified example of the present invention, in which FIG. 7A is a view showing a constitution on the resin-frame side and FIG. 7B is a view showing a constitution on the semiconductor-substrate side;

FIGS. 8A and 8B relate to another modified example of the present invention, in which FIG. 8A is a view showing a constitution on the resin-frame side and FIG. 8B is a view showing a constitution on the semiconductor-substrate side;

FIGS. 10A to 10D are views showing modified examples of the support unit provided at the connection terminal in the present invention, wherein FIG. 10A shows a case in which the top portion of the support unit is provided in a flat shape, FIG. 10B shows a constitution in which a through-hole is further provided at the top portion in FIG. 10A, FIG. 10C shows a constitution in which a notched hole is further provided at the top portion in FIG. 10A and FIG. 10D shows a state in which the support unit is formed by an arched curved-surface;

DESCRIPTION OF THE PREFERRED EMBODIMENTS

Hereinafter, there will be explained a manufacturing method of a coil component 10 relating to one embodiment of the present invention. It should be noted that on an occasion of explaining the manufacturing method of the coil component 10, first, there will be explained what constitution the coil component 10 has and thereafter, there will be explained the manufacturing method of the aforesaid coil component 10.

Figure 2:
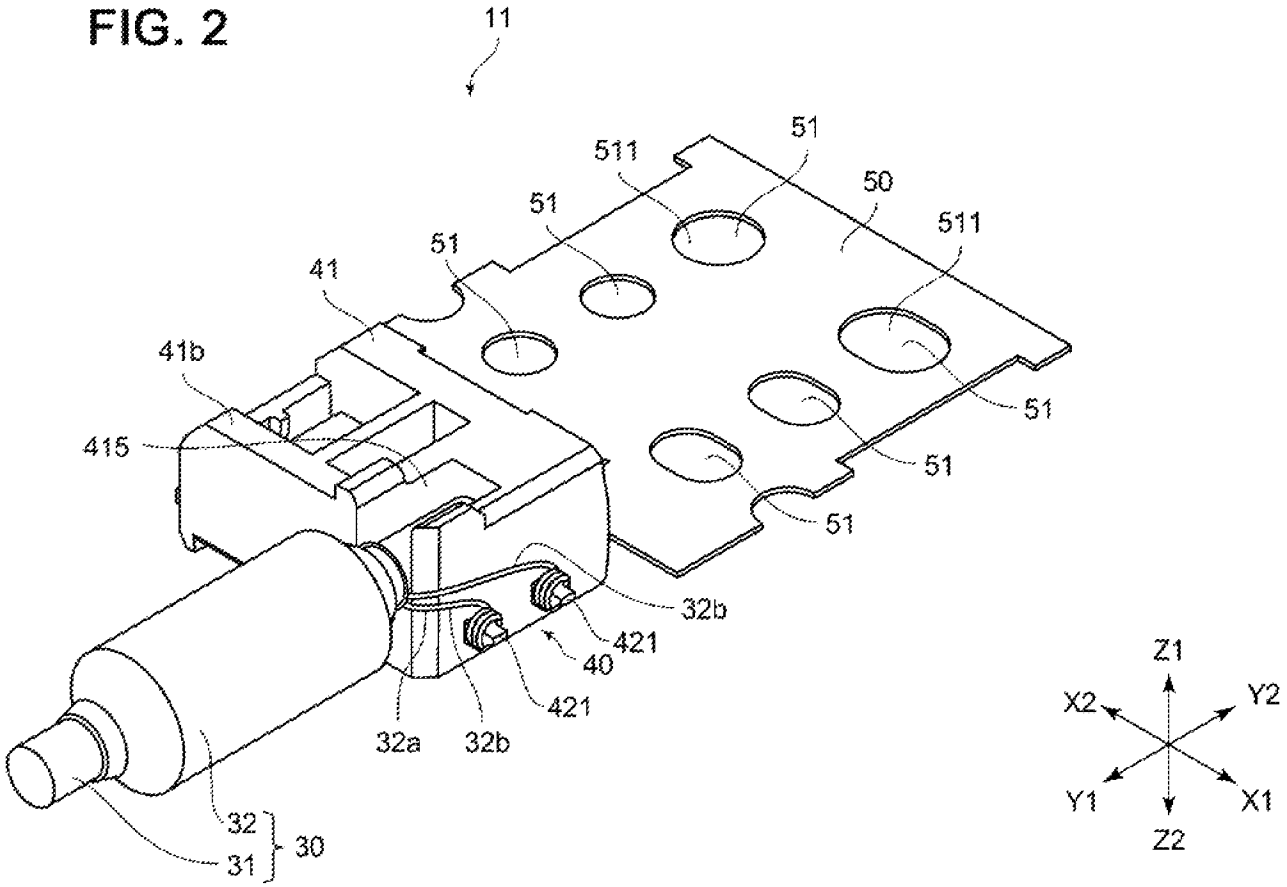
FIG. 2 is a perspective view showing a state of a semi-finished product before forming an overmold-portion.

It should be noted that in the following explanation, reference will be made to XYZ orthogonal coordinates, in which the extended direction of an antenna coil 30 which will be mentioned later (axis line direction) is made to be Y direction, the front side in FIG. 2 is made to be Y1 side and the back side opposite to that side is made to be Y2 side. In addition, the longitudinal direction of a base 40 in FIG. 2 is made to be X direction, the right and front side in FIG. 2 is made to be X1 side, and the left and back side which is opposite to that side is made to be X2 side. In addition, the thickness direction of the base 40 is made to be Z direction (up and down direction), the back side (upper side) in FIG. 2 is made to be Z1 side and the front side (lower side) which is opposite to that side is made to be Z2 side.

<With Regard to Constitution of Coil Component 10>

Figure 1:
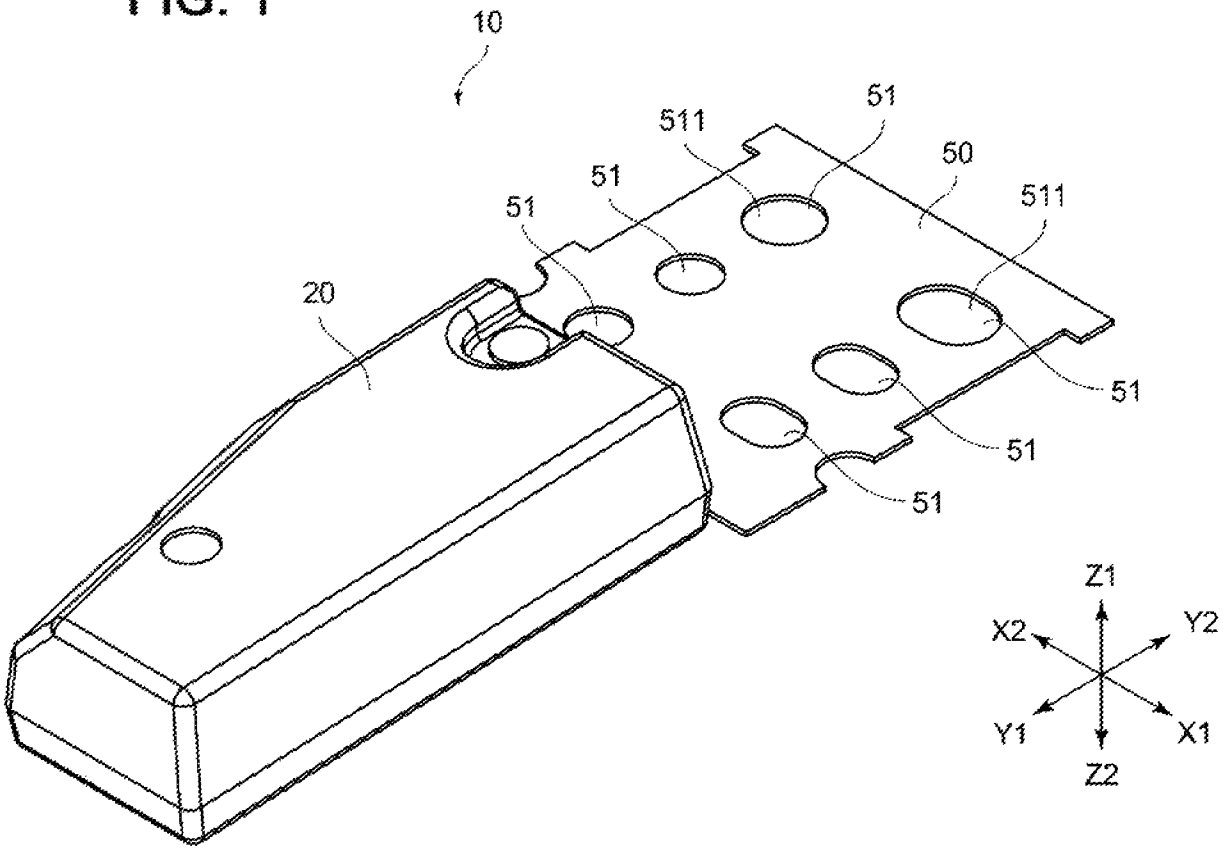
FIG. 1 is a perspective view showing a whole constitution of a coil component relating to one embodiment of the present invention.
Figure 3:
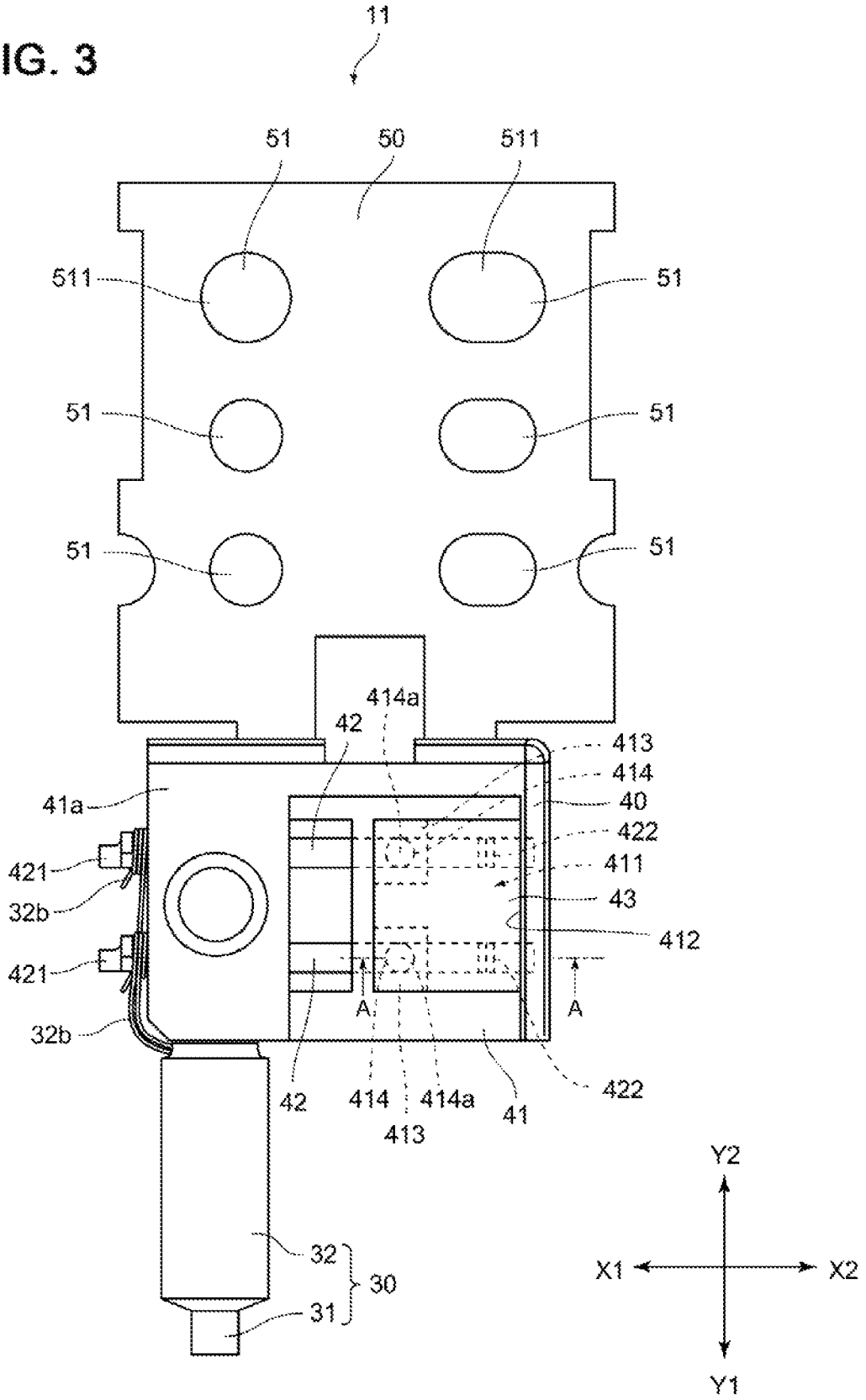
FIG. 3 is a plan view showing a state of the semi-finished product before forming the overmold-portion.
Figure 4:
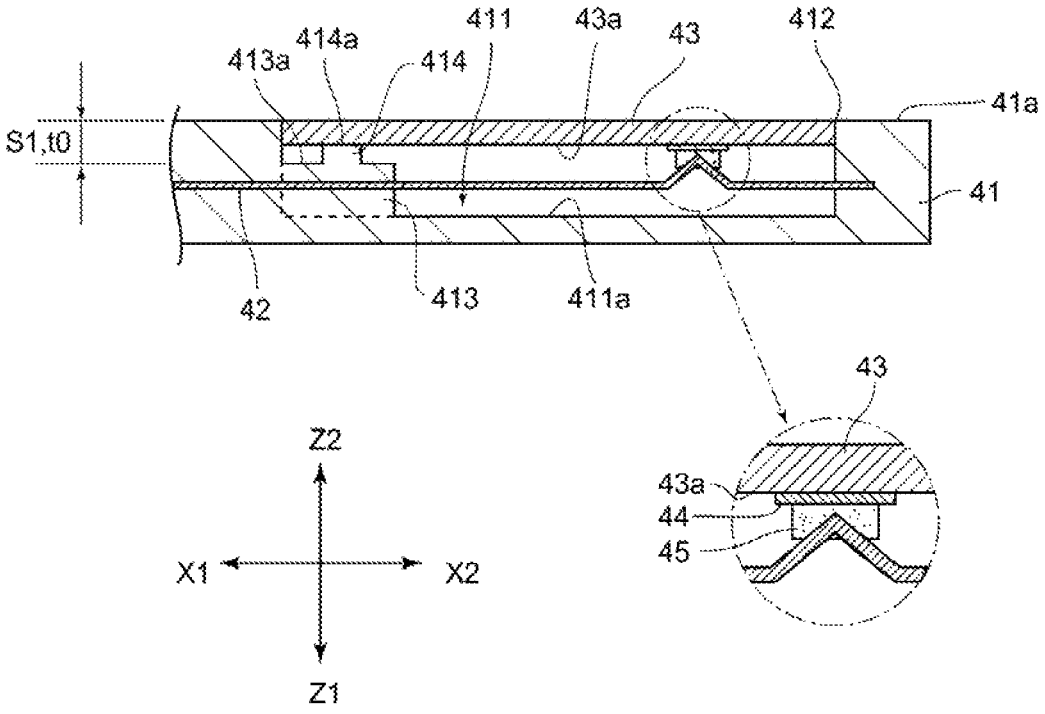
FIG. 4 is a cross-sectional side view showing an internal constitution of a resin frame in the semi-finished product before forming the overmold-portion.
Figure 5:
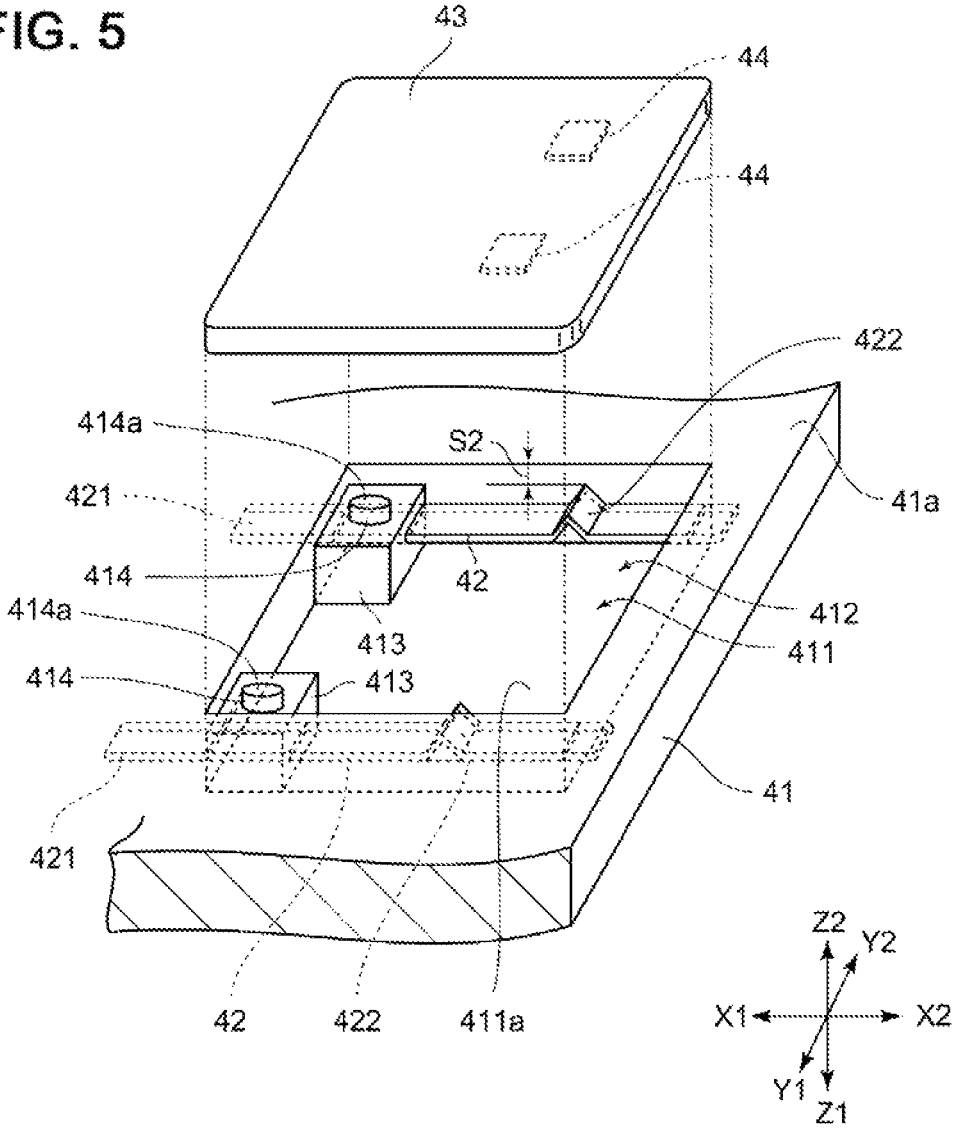
FIG. 5 is an exploded perspective view showing a hollow portion of the resin frame and a semiconductor substrate housed in the hollow portion thereof in the semi-finished product before forming the overmold-portion.

FIG. 1 is a perspective view showing a whole constitution of a coil component 10. FIG. 2 relates to the coil component 10 and is a perspective view showing a state of a semi-finished product 11 before forming an overmold-portion 20. FIG. 3 is a plan view showing a state of the semi-finished product 11 before forming the overmold-portion 20. FIG. 4 is a cross-sectional side view showing an internal constitution of a resin frame 41 in the semi-finished product 11 before forming the overmold-portion 20. FIG. 5 is an exploded perspective view showing a hollow portion 411 of the resin frame 41 and a semiconductor substrate 43 housed in the hollow portion 411 thereof in the semi-finished product 11 before forming the overmold-portion 20.

The coil component 10 is a component used, for example, for an immobilizer or a keyless entry system of a motor vehicle and the like, but there is no limitation in the above-mentioned use-application and it is possible to apply the component to various kinds of devices using the antenna coil 30 such as, for example, a communication function in a mobile terminal device and the like.

It should be noted that the actual product corresponds to a product obtained by removing the lead frame 50 from the coil component 10 in FIG. 1 through bending the lead frame 50 at the root of the overmold-portion 20 or the like. In other words, the coil component 10 of this embodiment is a component in a middle stage of the manufacturing and corresponds to the semi-finished product 11. In the following explanation, the component in a state of being attached to the lead frame 50 will be referred to as "coil component 10" and the component from which the lead frame 50 has been removed will be referred to as "coil product" as necessary. In addition, in the following explanation, the semi-finished product on the way of manufacturing the coil component 10 will be referred to as "semi-finished product 11" in any of the processing stages. However, there will be also a case in which this semi-finished product 11 is referred to as "coil component 10".

It should be noted that sometimes it is more preferable for some attachment-place of the coil product if the lead frame 50 was not removed therefrom. In that case, the coil component 10 as shown in FIG. 1 corresponds to a coil product.

As shown in FIGS. 1 and 2, the coil component 10 includes an overmold-portion 20, an antenna coil 30, a base 40 attached to the antenna coil 30 and a lead frame 50 as the main components thereof.

Figure 13:
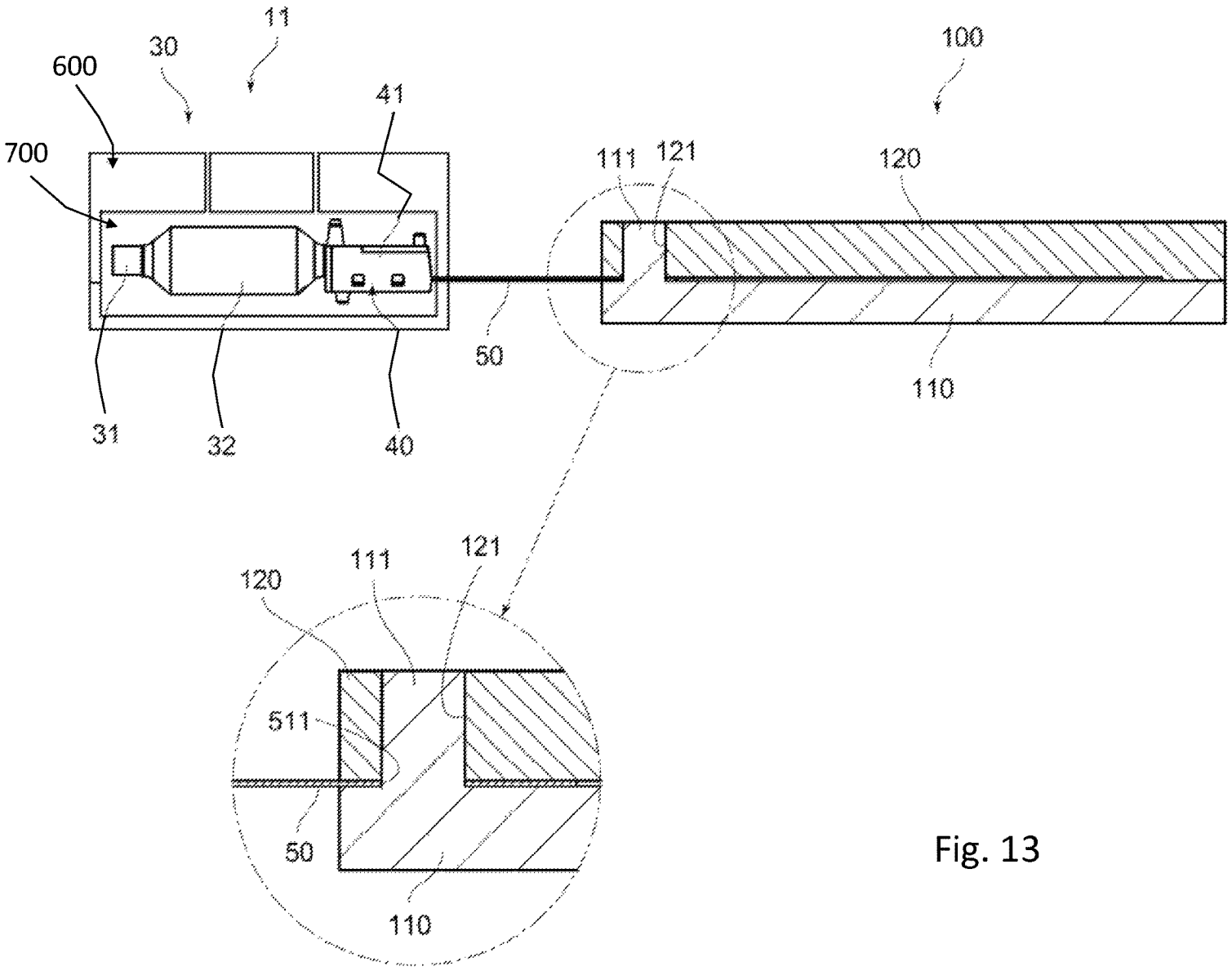
FIG. 13 relates to a manufacturing method of the coil component in this embodiment and is a cross-sectional side view showing a state in which a lead frame of a semi-finished product is held by the lower jig and the upper jig which constitute the jig.

As clear from the comparison between the configurations in FIGS. 1 and 2, the overmold-portion 20 is a portion which covers the antenna coil 30 and the base 40, and it is formed by molding a resin using a mold 600 (see FIG. 13). For this reason, for the outer appearance thereof, there is no protrusion from the overmold-portion 20 except the lead frame 50.

As shown in FIGS. 2 and 3, the antenna coil 30 includes a rod-shaped core 31 made from a magnetic material and a coil 32 arranged at the circumference of that rod-shaped core 31. For the magnetic material, it is possible to use various kinds of ferrites such as nickel-based ferrites or manganese-based ferrites or the like, nanocrystal magnetic alloys, Permalloy, Sendust, Permendur, amorphous magnetic alloy or the like, various kinds of magnetic materials, and mixtures of the various kinds of magnetic materials. In addition, it is allowed to form the rod-shaped core 31 by using a material formed by mixing a resin with any of those magnetic materials.

In addition, the coil 32 is formed by winding such a conductive wire 32*a* as an enamel wire or the like by a predetermined number of turns on the outer circumferential surface of the rod-shaped core 31. At that time, it is allowed to arrange an insulation sheet member (not shown) on the outer circumferential surface of the rod-shaped core 31 and to wind the conductive wire 32*a* over that insulation sheet member. The terminal end 32*b* of the conductive wire 32*a* forming this coil 32 will be bound onto a connection terminal, which will be mentioned later.

Such an antenna coil 30 is attached to the base 40, which will be explained next, for example, by means of an adhesive agent.

As shown in FIGS. 2 and 3, the base 40 is provided with a resin frame 41, connection terminals 42 and a semiconductor substrate 43. The resin frame 41 is integrated with the lead frame 50 and the connection terminal 42 by applying an insert-molding in which a resin material is poured into the internal space of a mold 600 (see FIG. 13).

As shown in FIGS. 2 and 3, the resin frame 41 is provided with a hollow portion 411 which is recessed from the rear-surface side (lower-surface 41*a* side). For this reason, the rear-surface side (lower-surface 41*a* side) of the resin frame 41 is provided with an opening 412 which communicates with the hollow portion 411. As shown in FIGS. 2 to 5, the hollow portion 411 is a portion for housing the semiconductor substrate 43 and this portion is formed such that the semiconductor substrate 43 is housable in a state of being parallel to the XY plane. Therefore, the hollow portion 411 has an area wider than the plane formed by the semiconductor substrate 43 and in addition, the depth thereof is provided in such a degree that the semiconductor substrate 43 is sufficiently housable. It should be noted that it is allowed even if the hollow portion 411 is not always formed in a bottomed shape having the bottom surface 411*a* and it is also allowed to employ a hole shape which passes through the up and down direction.

In addition, the connection terminals 42 are metal-made conductors and are made of a material of a metal-made plate material such as, for example, a copper alloy, a stainless steel or the like which has elasticity having strength and hardness to a certain degree. Then, by press-processing that material, the connection terminals 42 are formed. However, it is allowed for the connection terminals 42 to use a material of another metal and, in addition, it is also allowed to form them by a production method other than the press-processing method. A portion of each connection terminal 42 is buried in the resin frame 41. In this manner, the connection terminal 42 is supported by the resin frame 41. One end of each connection terminal 42 protrudes from the overmold-portion 20. For this reason, at the one end of each connection terminal 42, there is formed a binding portion 421 for binding the terminal end 32*b* of the conductive wire 32*a*.

It should be noted that it is preferable for the material of the connection terminals 42 to be formed of the same material as the lead frame 50 from the viewpoints of manufacturing convenience and cost reduction. In particular, in a case of providing a support unit 422 (for supporting the semiconductor substrate 43) at a portion of the connection terminal 42, as mentioned later, it is desirable to use a metal material having a predetermined hardness and it is preferable for such a hardness to be from 50 Hv or more to 300 Hv or less on the Vickers hardness scale. However, such a hardness will be changed in consideration of the good balance of the dimensions such as thickness, length or the like of the connection terminal 42 and the like and therefore, it is allowed for the hardness of the connection terminal 42 to take a numerical value other than the value in the above-mentioned range.

The explanation will return to that of the abovementioned resin frame 41. As shown in FIGS. 3 to 5, there is provided a pedestal 413 at the hollow portion 411 of the resin frame 41. The pedestal 413 is a portion protruding so as to be directed upward from the bottom surface 411*a* of the hollow portion 411. It should be noted that the up and down sides are illustrated in FIGS. 4 and 5 by being reversed and therefore, there is illustrated a configuration therein in which the bottom surface 411*a* is positioned on the upper side (Z1 side).

The pedestal 413 is provided at two corner portions which are positioned on the X1 side in the rectangular-shaped hollow portion 411. In addition, from the protruding end surface (lower surface 413*a*) of the pedestal 413, a protruding portion 414 further protrudes toward the lower side (Z2 side). Then, at this protruding portion 414, there is placed a portion of the semiconductor substrate 43 of the X1 side. At that time, the distance S1 between the lower surface 414*a* of the protruding portion 414 and the lower surface 41*a* (see FIG. 4) is formed to be a size having an equivalent thickness to the thickness t0 of the semiconductor substrate 43 (the thicknesses of the pad 44 and the solder layer 45 mentioned later are not added to this thickness t0). Therefore, there is provided a constitution in which the semiconductor substrate 43 does not protrude from the lower surface 41*a*.

In addition, at the resin frame 41 of the base 40, there is provided an attachment concave-portion 415 for attaching the rod-shaped core 31. The attachment concave-portion 415 is formed by recessing the upper surface 41*b* of the resin frame 41 by a predetermined depth. In the configuration shown in FIG. 2, the attachment concave-portion 415 is provided on the side adjacent to the binding portion 421 and, because of this configuration, it is possible to shorten the length of the terminal end 32*b*. The portion on the front side (Y1 side) of this attachment concave-portion 415 is open, so that it is possible for the rod-shaped core 31 to extend toward the outside of the resin frame 41.

In addition, one end (Y1 side) of the lead frame 50 is buried in the abovementioned resin frame 41. This lead frame 50 is formed by punching-out a metal-made plate material such as, for example, a copper alloy or a stainless steel or the like by using a press-processing or the like. However, it is allowed for the lead frame 50 to use a material of another metal and, in addition, it is also allowed to form the lead frame 50 by using a production method other than the press-processing method.

The lead frame 50 is provided with a plurality of hole-portions 51. Among this plurality of hole-portions 51, attachment holes 511 are provided on the most rearward side (Y2 side). The attachment hole 511 is a portion into which a protruding portion 111 of a lower jig 110 of the jig unit 100 such as mentioned later is plugged-in. It should be noted that it is allowed to employ a configuration in which all of the plurality of hole-portions 51 are made to be attachment holes 511 into which the protruding portions 111 are plugged-in. In addition, the protruding portions 111 and insertion holes 121 mentioned later correspond to holding portions.

In the present example, the semiconductor substrate 43 is formed by a semiconductor material such as of a single-crystal/polycrystal Si substrate, SiC substrate, a GaN substrate or the like and in the inside thereof, there is formed a multi-layered integrated circuit. In addition, as shown in FIGS. 2 to 5, on the side of the surface (upper surface 43*a*) which is attached toward the bottom surface 411*a* of the hollow portion 411, there are arranged a pair of pads 44 as electrical-connecting area portions. Each pad 44 is provided at a position facing the support unit 422 of a respective connection terminal 42. The pad 44 is formed generally by an alloy or a compound which has good compatibility with both of the semiconductor and the metal, and the pad is formed by a material having conductivity. On the surface of the pad 44, there is formed a cream-like solder layer 45 including tin as the main component thereof. It should be noted that in order to prevent a scratch or the like on the semiconductor substrate 43 from being caused by the connection terminal 42, it is preferable for the height hl of the solder layer 45 to be from 5 times or more to 20 times or less of the height of the pad 44. For one example of the dimensions, there exists a case in which the height of the pad 44 is approximately 0.008 mm and the total height formed by the solder layer 45 added with the pad 44 is from 0.06 mm or more to 0.10 mm or less. However, it is allowed for the dimensions thereof to employ other numerical values.

Hereinafter, supposing that there will be explained the semi-finished product 11 before forming the overmold-portion 20 in a condition of turning upside down, the semiconductor substrate 43 is housed into the hollow portion 411 in a state that the upper surface 43*a* thereof is directed downward. Then, the solder layer 45 and the pad 44 are arranged at the position facing to the support unit 422 of the connection terminal 42. In addition, at the stage before the solder layer 45 melts, the solder layer 45 is in contact with the support unit 422. In addition, the upper surface 43*a* of the semiconductor substrate is in contact with the lower surface 414*a* of the abovementioned protruding portion 414. More specifically, the semiconductor substrate 43 is supported at four points: by the lower surfaces 414*a* of the protruding portions 414 and by the support units 422.

In this state, the coil component 10 is placed in a reflow furnace and by adding a hot air of a predetermined temperature such that the solder layer 45 will melt, the solder layer 45 melts and, when the solder layer 45 is hardened by the cooling thereafter, there will be obtained such a state which is shown by being enlarged in a circle of a dot-dash line in FIG. 4. More specifically, it becomes a state in which the support unit 422 enters into the inside of the solder layer 45. In this manner, the semiconductor substrate 43 will be integrally attached with respect to the support unit 422 (connection terminal 42).

It should be noted that even in a stage before the solder reflow, it is allowed for the support unit 422 to enter into the solder layer 45 caused by the own weight of the semiconductor substrate 43. However, even in this case, the weight of the semiconductor substrate 43 is light and therefore, as shown in FIG. 6B, the lower end portion of the support unit 422 does not enter deeply enough to reach the pad 44.

Figure 6A:
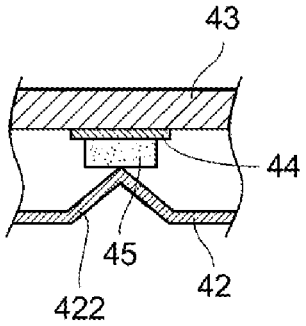
Figure 6B:
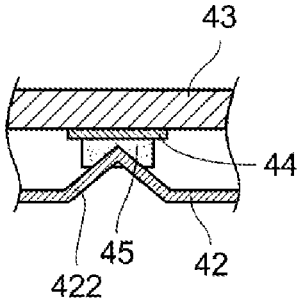

In addition, the pad 44 and the support unit 422 are not directly in contact with each other, such as shown in FIG. 6B, even after the solder reflow-process. More specifically, the solder of solder layer 45 melts during the solder reflow, but the weight of the semiconductor substrate 43 is light, so that there are many cases in which although the support unit 422 of the connection terminal 42 enters-in over the whole thickness of the solder layer 45, it is not in contact with the pad 44.

However, in the case that the pad 44 will not be broken at all thereby, it is allowed to employ a configuration in which the support unit 422 of the connection terminal 42 is directly in contact with the pad 44.

Figure 7B:
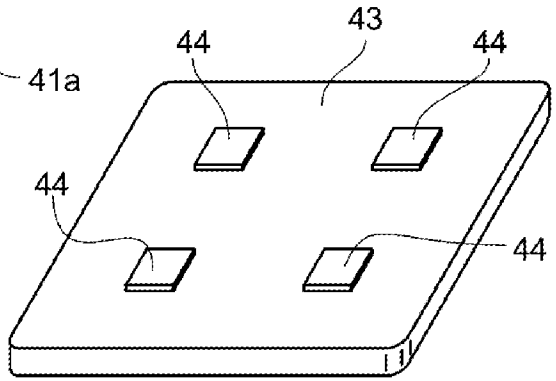
Figure 7A:
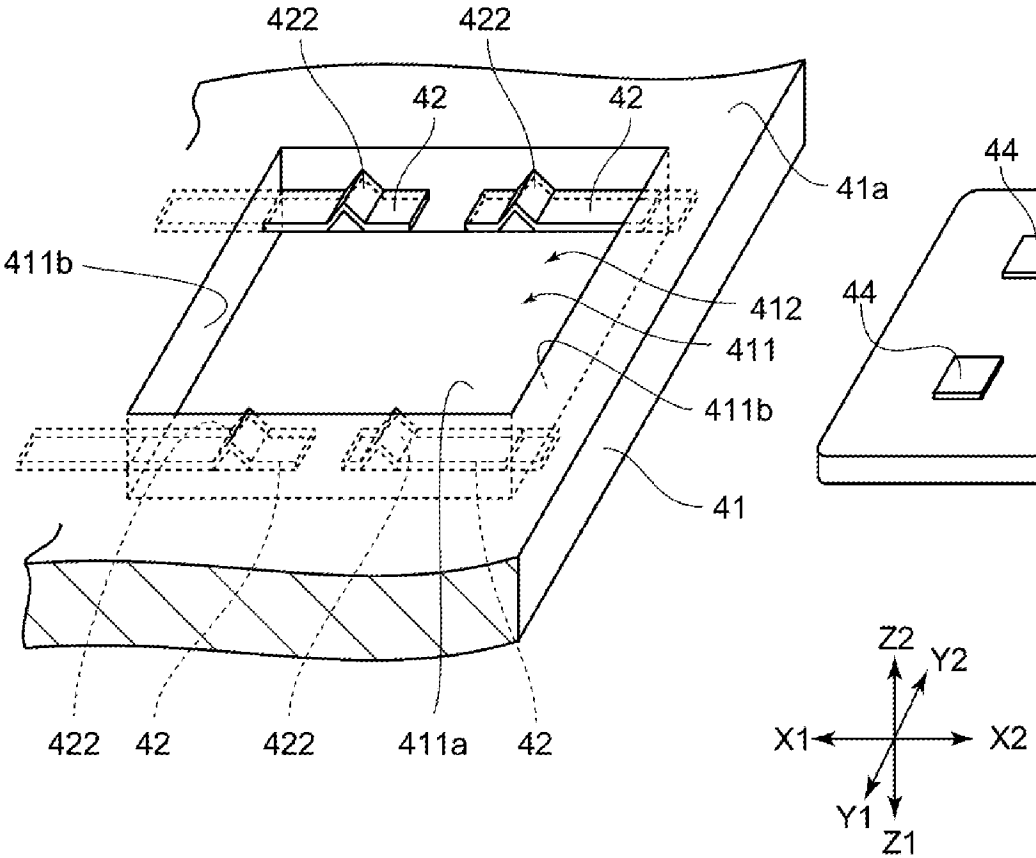

It should be noted that it is also possible for the internal constitution of the hollow portion 411 to employ a modified configuration such as shown in FIG. 7. In the modified example shown in FIG. 7, there is employed a configuration, as shown in FIG. 7A, in which the respective connection terminals are extended in cantilever shapes from the right and left inner-side surfaces 411*b*, 411*b* of the hollow portion 411 by using two pieces for each connection terminal and there are provided four connection terminals 42 in total. In addition, at the free ends of the four connection terminals 42, which respectively extend toward the inside of the hollow portion 411, there are provided support units 422. In addition, the distance S2 from the top of the support unit 422 to the opening 412 is formed to be a little bit longer compared with the thickness t1 of the semiconductor substrate 43.

On the other hand, as shown in FIG. 7B, for the semiconductor substrate 43 housed in the inside of the hollow portion 411, the pads 44 each of which includes a solder layer 45 are respectively provided at the positions corresponding to those of the four support units 422. For this reason, with regard to the semiconductor substrate 43, the semiconductor substrate 43 is arranged at the hollow portion 411 so as to be placed such that the upper surface 43*a* thereof is directed toward the downward direction (direction toward Z1 side) in which the solder layer 45 is made to be a state of being supported by the support unit 422. In this state, when the semi-finished product 11 is made to enter into the reflow furnace (not shown) and hot air is added, the solder layer 45 is melted. Thereafter, the solder layer 45 is hardened by cooling and the melted solder layer 45, the semiconductor substrate 43 and the connection terminal 42 are fixed electrically and mechanically.

In such a configuration shown in FIG. 7, it is made possible to support the semiconductor substrate 43 by respectively providing support units 422 at the four connection terminals 42, and the pedestals 413 and the protruding portions 414 as mentioned above are eliminated. In this manner, it is possible to fix the semiconductor substrate 43 with the solder layer 45 integrally after the reflow. In addition, it is possible for two of the connection terminals 42 to be connected to the terminal ends 32*b* of the coil 32 and it is also possible for the remaining two connection terminals 42 to be connected to another electric circuit.

Figure 8A:
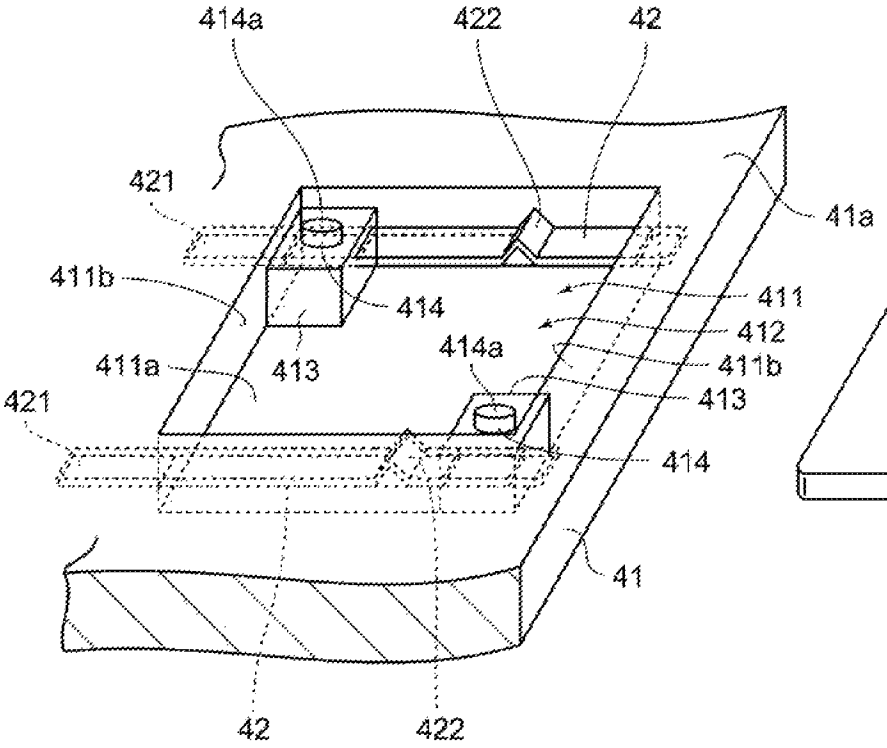
Figure 8B:
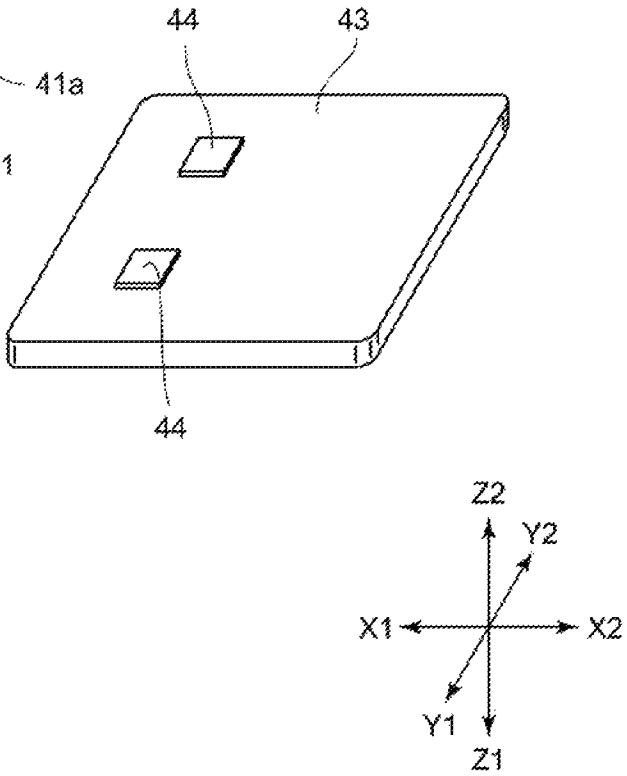

In addition, it is possible to modify the internal constitution of the hollow portion 411 such as shown in FIG. 8. In the modified example shown in FIG. 8, there are provided the abovementioned pedestal 413 and protruding portion 414 at two diametrically-opposite corners of the hollow portion 411, such as shown in FIG. 8A. Also in this case, the distance S2 from the lower surface 414*a* of the protruding portion 414 to the opening 412 is formed to be approximately the same as the thickness t0 of the semiconductor substrate 43. In addition, for the connection terminals 42, there are provided support units 422 at similar positions in the X direction as those in FIG. 5 which were already mentioned.

On the other hand, for the semiconductor substrate 43, there are provided pads 44 and solder layers 45 at similar positions as those in FIG. 5. For this reason, after the reflow-process, similarly as mentioned above, the semiconductor substrate 43 and the connection terminal 42 are fixed electrically and mechanically.

Figure 9:
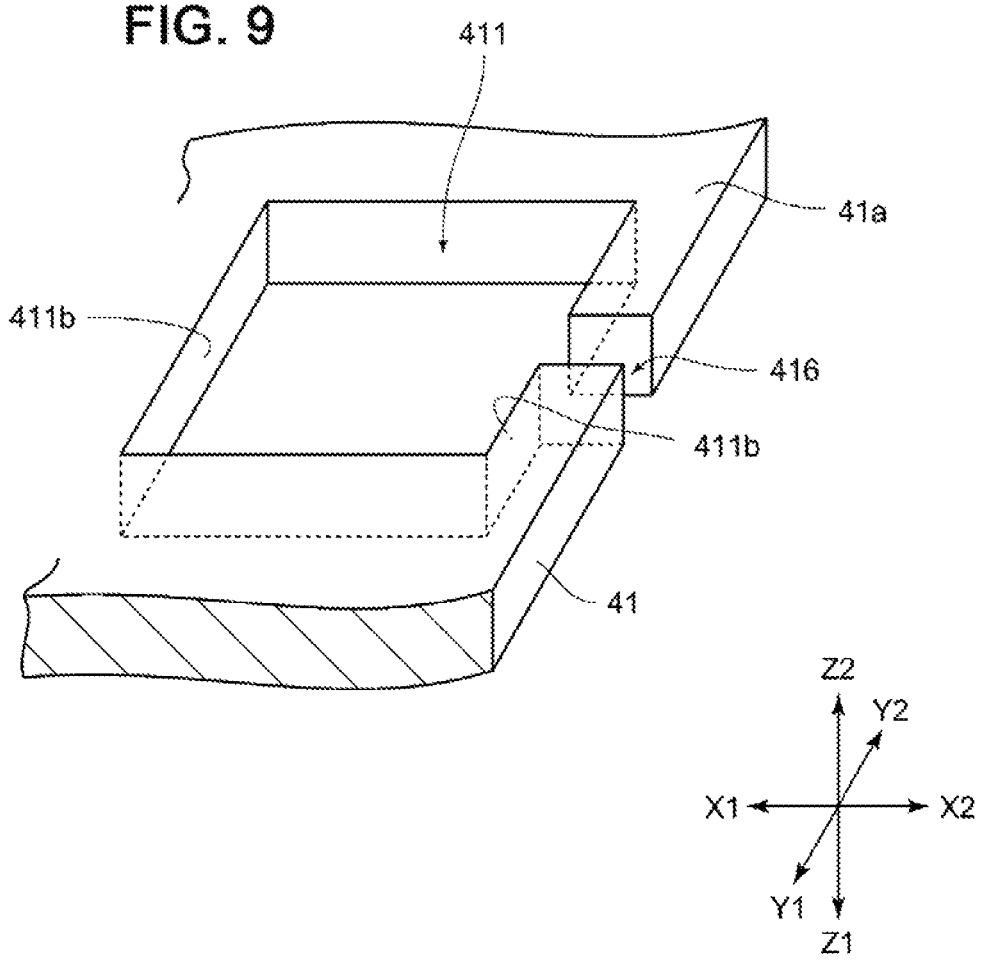
FIG. 9 relates to still another modified example of the present invention and shows a constitution of the resin-frame.

In addition, the abovementioned hollow portion 411 is formed in a seamless concave shape in which four inside surfaces are continuous. However, it is possible to modify the shape of the hollow portion 411 such as shown in FIG. 9. For the hollow portion 411 shown in FIG. 9, at one inside surface thereof, there is provided a cut-out portion 416 which is continuous as far as the outside surface. In case of providing such a cut-out portion 416, even in such a case in which the size of the opening 412 of the hollow portion 411 is smaller than the area of the semiconductor substrate 43, the opening 412 can be expanded owing to the cut-out portion 416 thereof, so that it is possible to absorb the error or the like with respect to the semiconductor substrate 43. In addition, it is possible to absorb the thermal expansion of the semiconductor substrate 43 and the resin frame 41.

In addition, it is also possible for the support unit 422 of the connection terminal 42 to be modified such as shown in FIG. 10. FIGS. 10A to 10D are views showing modified examples of the support unit 422 provided at the connection terminal 42. FIG. 10A shows a case in which the V-shaped top portion 422*a* of the support unit 422 is formed in a flat shape and the top portion 422*a* thereof is abutted against the solder layer 45 in a manner of surface contact. According to this shape, it is possible to adjust so as to delay the speed of the support unit 422 entering into the inside of the solder layer 45.

Figure 10A:
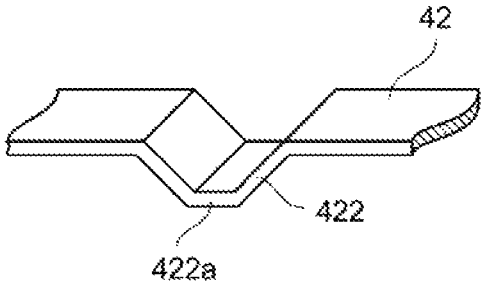
Figure 10B:
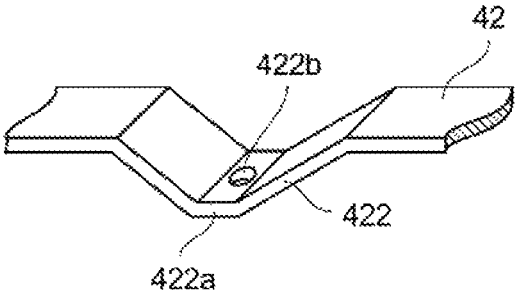
Figure 10C:
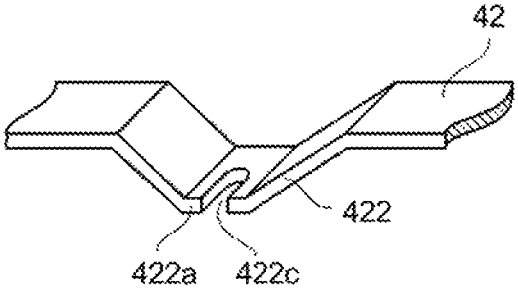
Figure 10D:
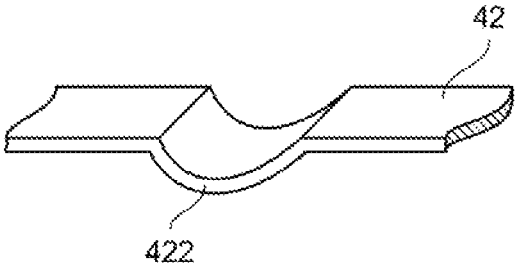

FIG. 10B shows a case obtained by modifying the case of FIG. 10A and shows a constitution in which a through-hole 422*b* is provided at the top portion 422*a*. According to this shape, the melted solder layer 45 enters into the inside of the through-hole 422*b*, so that it is possible to achieve an integration with the support unit 422. FIG. 10C shows a case obtained similarly by modifying the case of FIG. 10A and shows a constitution in which there is provided a notched hole 422*c* which is notched from the side of the top portion 422*a*. Even according to this shape, the melted solder layer 45 enters into the inside of the support unit 422, so that it is possible to achieve an integration with the support unit 422. FIG. 10D shows a case in which the support unit 422 is formed in an arch-shaped curved-surface and the curved-surface is abutted against the solder layer 45 by means of the curved-surface. Even according to this shape, it is possible to adjust so as to delay the speed of the support unit 422 entering into the inside of the solder layer 45.

In addition, in the above-mentioned explanation, there is disclosed a constitution in which at the time of the solder reflow, the support unit 422 enters into the inside of the solder layer 45 by a phenomenon that the semiconductor substrate 43 descends into the inside of the melted solder layer 45 caused by its own weight. However, contrary to that aspect, it is also possible to carry out the connection by utilizing the own weight of the resin frame 41.

<With Regard to Manufacturing Method of Coil Component 10>

Figure 11:
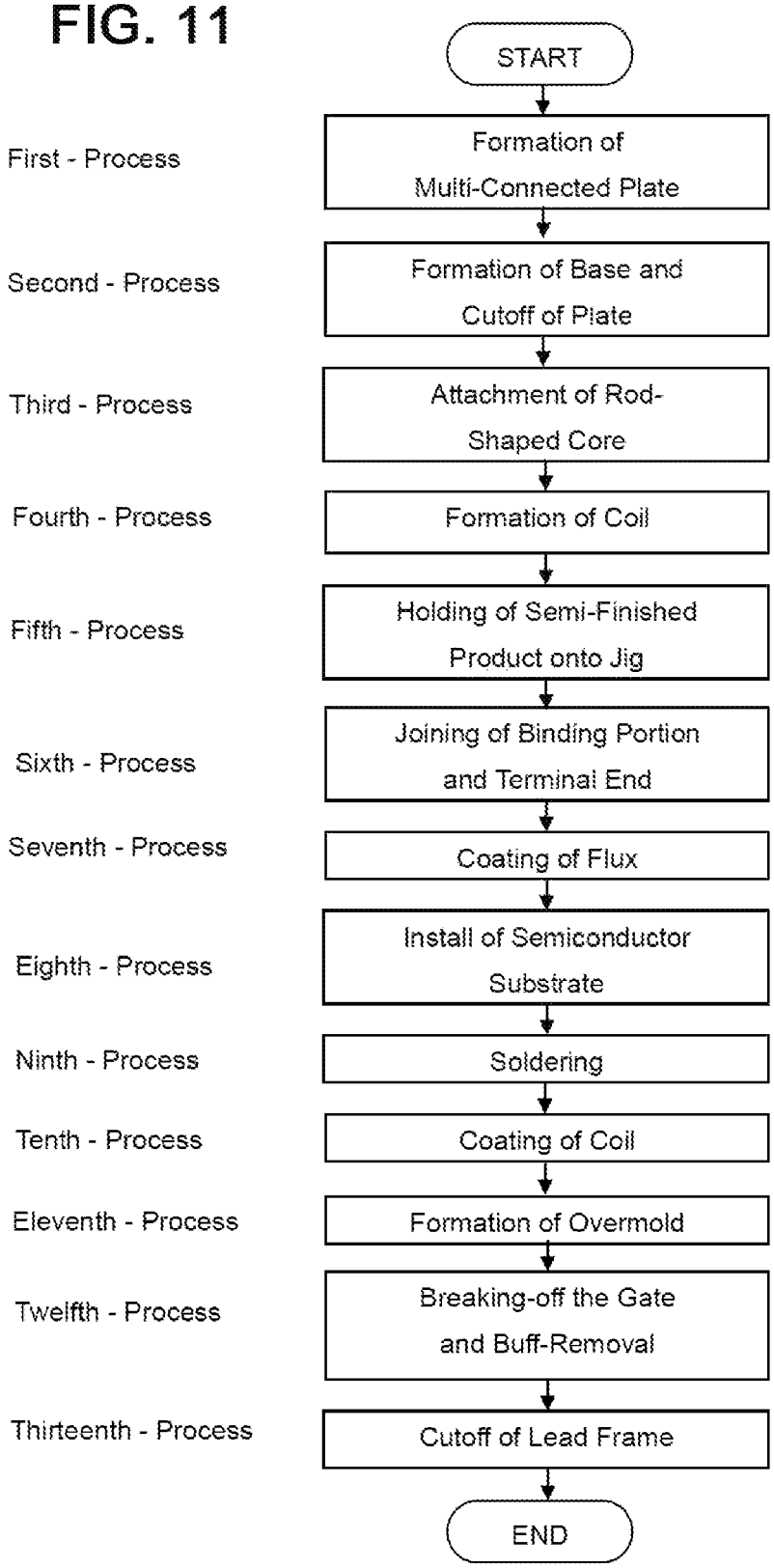
FIG. 11 is a chart showing a flow of a manufacturing method of the coil component in this embodiment.

Next, there will be explained a manufacturing method of the coil component 10 as mentioned above. FIG. 11 is a chart showing a flow of a manufacturing method of the coil component 10. Hereinafter, there will be an explanation based on FIG. 11.

(1) First-Process: Formation of Multi-Connected Plate

First, a copper plate is prepared and a multi-connected plate is formed by that copper plate. The multi-connected plate means a plate on which a large number of lead frames 50 as mentioned above are formed to be continuous and integrated. As mentioned below, a large number of separate lead frames 50 are formed by cutting-off those lead frames 50, along boundaries between them, in a later process.

(2) Second-Process: Formation of Base 40 and Cutoff of Plate

Subsequently, bases 40 will be formed by applying insert-molding by using the abovementioned multi-connected plate. At that time, the abovementioned plate and connection terminals 42 are set at predetermined positions of the cavity of the mold to which the insert-molding is applied. Thereafter, a melted resin is injected. Then, the bases 40 will be formed after the cooling thereof. Next, the boundaries which become the lead frames 50 as mentioned above will be cut off. In this manner, there will be formed a large number of intermediate products, in each of which the base 40, the connection terminals 42 and the lead frame 50 are integrated.

(3) Third-Process: Attachment of Rod-Shaped Core 31

Next, the rod-shaped core 31 is attached to the base 40. In the case of carrying out this attachment, the rod-shaped core 31 is arranged at an attachment concave-portion 415 and, at that time, the rod-shaped core 31 is attached to the attachment concave-portion 415 through an adhesive agent, but it is allowed for the rod-shaped core 31 to be fixed onto the attachment concave-portion 415 by another technique (for example, a technique using a presser). It should be noted that this third-process corresponds to the assembling-process.

(4) Fourth-Process: Formation of Coil 32

Next, the coil 32 is formed by winding the conductive wire 32*a* with respect to the rod-shaped core 31 (corresponding to the wire-winding-process). At that time, a wire-winding machine is used, but the winding of the conductive wire 32*a* becomes easy remarkably compared with a case in which the base 40 is not cut-off from the plate as mentioned above. More specifically, in a case in which the conductive wire 32*a* is wound around the rod-shaped core 31 while a large number of bases 40 are attached to the plate and the rod-shaped cores 31 are attached to that large number of bases 40, it is necessary to widen the space between the rod-shaped cores 31 which are adjacent to each other. And in addition, it is necessary to use a special machine in which a portion for carrying out the wire-winding can rotate around the circumference of the rod-shaped core 31, or do something like that in the wire-winding process. However, it is unnecessary to widen the space between the rod-shaped cores 31 or the like because the base 40 can be cut away from the plate beforehand. And in addition, it also becomes unnecessary to use the special wire-winding machine.

In addition, after the wire-winding around the rod-shaped core 31 is finished, the terminal ends 32*b* of the conductive wire 32*a* are bound onto the binding portions 421.

(5) Fifth-Process: Holding of Semi-Finished Product 11 onto Jig 100

Figure 12:
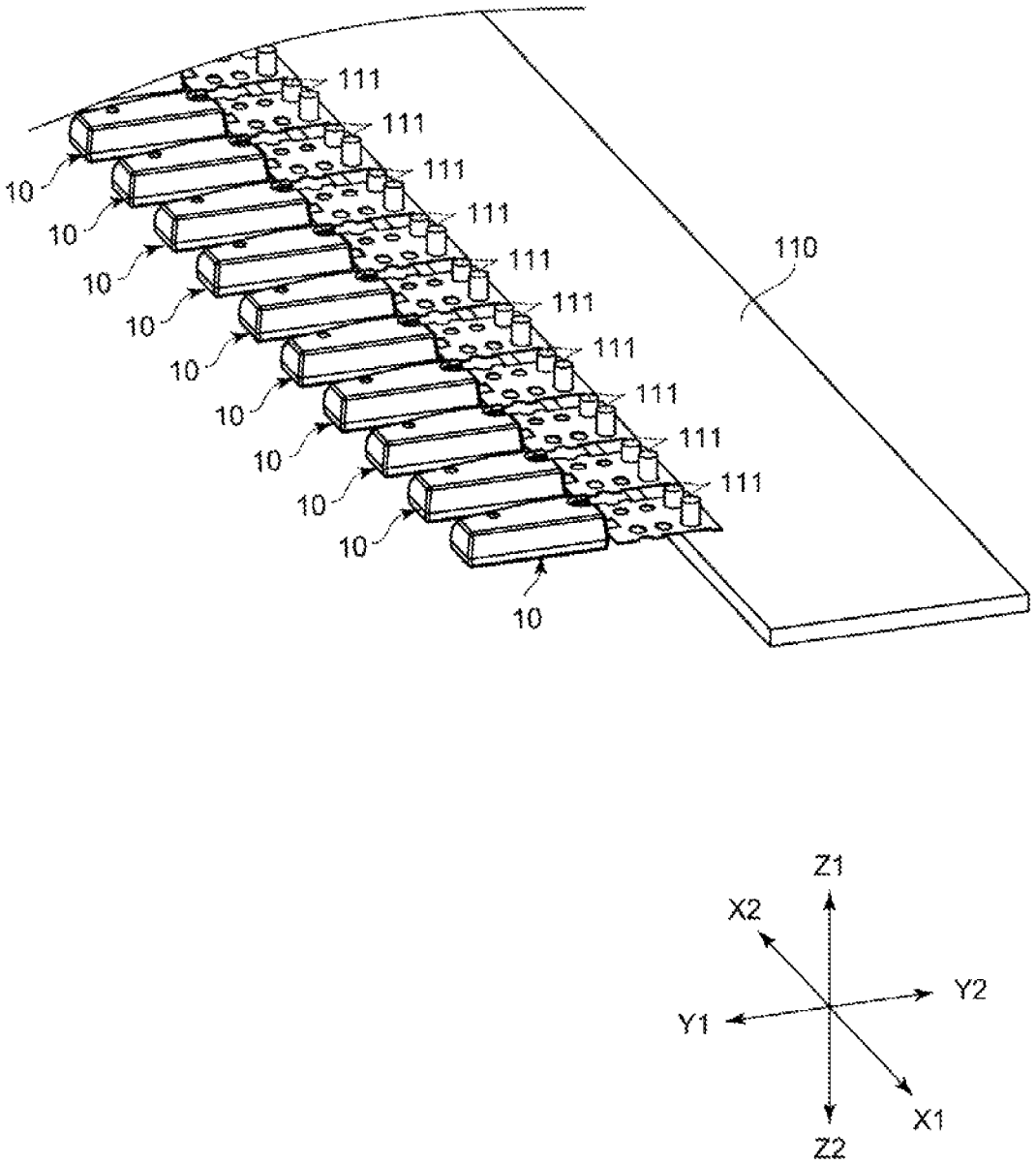
FIG. 12 relates to a manufacturing method of the coil components in this embodiment and is a perspective view showing a state in which the semi-finished products of the coil components are set onto a lower jig which is a portion of the jig.

Next, a plurality of semi-finished products 11, in each of which the coil 32 is formed, are held by the jig 100 (corresponding to the holding-process). At that time, there is used such a jig 100 as shown in FIGS. 12 and 13. FIG. 12 is a perspective view showing a state in which the semi-finished product 11 of the coil components 10 are set onto the lower jig 110 which is a portion of the jig 100. FIG. 13 is a cross-sectional side view showing a state in which a lead frame 50 of a semi-finished product 11 is held by the lower jig 110 and the upper jig 120 which constitute the jig 100. FIG. 13 further shows a mold 600 in which each of the semi-finished products 11 is placed. Further, the mold 600 has a cavity 700 therein. A resin is supplied into the cavity 700 (See "(11) Eleventh-Process: Formation of Overmold-Portion 20" below).

As shown in FIGS. 12 and 13, the jig 100 is provided with a lower jig 110 and an upper jig 120. The plate-shaped lower jig 110 is provided with protruding portions 111. Similarly, the plate-shaped upper jig 120 is provided with insertion holes 121 for inserting the abovementioned protruding portions 111 therethrough. Then, by inserting the protruding portions 111 through the attachment holes 511 of the lead frames 50 and by inserting the protruding portions 111 thereof through the insertion holes 121, the lead frames 50 are sandwiched by the lower jig 110 and the upper jig 120. For this reason, it is possible to hold the semi-finished products 11 of the plurality of coil components 10 by the jig 100.

It is possible for the attachment between the lower jig 110 and the upper jig 120 to use various kinds of techniques. For example, it is allowed to carry out the attachment between the jigs by using a magnet, or it is also allowed to employ a constitution in which there will be provided a hole and a hook-shaped portion to be inserted into that hole at the corresponding portions of the lower jig 110 and the upper jig 120 and the jigs are engaged and fixed by means of them. In addition, it is also allowed to employ a constitution in which the lower jig 110 and the upper jig 120 are sandwiched by, for example, a U-shaped clip member separately.

(6) Sixth-Process: Joining of Binding Portion 421 and Terminal End 32*b*

Next, the binding portions 421 and the terminal ends 32*b* are joined so as to have electrical conductivity by using such a technique as, for example, a laser technique, a soldering technique or the like (corresponding to the connection-process). In this manner, it is possible for a signal electric-current based on the electromagnetic wave received by the antenna coil 30 to flow into the connection terminals 42 and to be supplied to the semiconductor substrate 43. In case of carry out this joining, the plurality of the semi-finished products 11 are held in the jig 100 and therefore, it becomes possible to carry out the joining such as, for example, a laser welding, a soldering or the like efficiently, and it is possible to improve the joining efficiency.

(7) Seventh-Process: Coating of Flux

Next, the solder layer 45 is formed by coating a solder cream onto the semiconductor substrate 43 and in addition, a flux is coated onto the connection terminals 42 of the support units 422. It should be noted that contrary to this aspect, it is allowed to employ a configuration in which the solder cream is coated onto the support units 422 and the flux is coated onto the semiconductor substrate 43. It should be noted that for the plurality of the semi-finished products 11 which are held by the jig 100, the coating of the flux and the solder cream can be carried out with respect to the support units 422, so that it is possible to carry out that coating operation efficiently.

(8) Eighth-Process: Install of Semiconductor Substrate 43

Next, the semiconductor substrates 43 are installed on the support units 422 of the respective semi-finished products 11 (corresponding to the installation-process). At that time, the semiconductor substrate 43 is placed also on the protruding portions 414 and the semiconductor substrate 43 is supported by four points.

(9) Ninth-Process: Soldering

Subsequently, every jig 100 with the semiconductor substrate 43 placed on the support unit 422 enters into the reflow furnace. Then, the semiconductor substrate 43 and the connection terminal 42 are integrated by melting the solder layer 45 by using hot air.

(10) Tenth-Process: Coating of Coil 32

Next, the coating of the coil 32 is carried out. In that case, while holding the plurality of the semi-finished products 11 in the jig 100, the coils 32 of those semi-finished products 11 are dipped into a resin liquid for coating, which is filled in a resin bath. In this manner, the coil 32 is coated with the resin and the coil 32 is protected by the coating layer.

(11) Eleventh-Process: Formation of Overmold-Portion 20

Subsequently, the overmold-portion 20 is formed. For the formation of this overmold-portion 20, the plurality of the semi-finished products 11 which are held by the jig 100 are set in the cavity 700 of the mold 600 (See FIG. 13) for transfer-molding (corresponding to the setting-process). At the time of this setting, the portion of the lead frame 50 on the jig 100 side is protruded from the cavity 700 of the mold 600. Then, the resin pellets which become a raw material are supplied and those pellets are supplied to the cavity 700 in a melted state. In this manner, simultaneously, the overmold-portion 20 is formed for each of the plurality of semi-finished products 11. And there is formed the semi-finished product 11 in which the antenna coil 30 and the base 40 are sealed by the overmold-portion 20 (corresponding to the sealing-process).

(12) Twelfth-Process: Breaking-Off the Gate and Burr-Removal

Next, with respect to the semi-finished product 11, a resin portion corresponding to the gate of the mold and a burr portion of the overmold-portion 20 after the transfer-molding are removed (corresponding to the removing-process). In the breaking off process for removing the resin portion correspond to the gate, the resin portion corresponding to that gate is cut-off by maintaining the grasping of the jig 100 placed on an installation portion such as a workbench or the like and by pressing the resin portion corresponding to the gate onto the installation portion (to break off the gate). In addition, with regard to the burr, this is removed, for example, by a blasting treatment by using resin beads. In this manner, a plurality of coil component products 10 as shown in FIG. 1 are formed simultaneously.

(13) Thirteenth-Process: Cutoff of Lead Frame 50

Next, the lead frame 50 is cut-off (corresponding to the cutting-off-process). In this manner, there is formed the coil product which is covered by the overmold-portion 20 as a whole with the trace of the lead frame 50 that has been cut-off. Then, this coil product is packaged. It should be noted that after the cutoff is carried out, the lower jig 110 and the upper jig 120 are released and the residuals (portions which did not form the coil products) of the lead frames 50 are removed. Then, the jig 100 constituted by the lower jig 110 and the upper jig 120 is reused for the next manufacturing of the coil components 10.

By applying the respective processes as described above, the coil products are formed by the coil components 10.

<About Manufacturing Method of Coil Component 10>

As described above, according to this embodiment, a plurality of semi-finished products 11, each of which includes a base 40 and an antenna coil 30 before forming the coil component 10, are held with respect to a jig 100 having holding portions (protruding portions 111 and insertion holes 121) (corresponding to the holding-process). Thereafter, the plurality of semi-finished products 11 are set with respect to the setting portions of the jig 100 in a mold 600 (see FIG. 13) in a state of being held by the jig 100 (corresponding to the setting-process). Thereafter, by filling a resin in a cavity 700 (see FIG. 13) of the mold 600, at least a portion within the base 40 and the antenna coil 30 is sealed with the resin (corresponding to the sealing-process).

For this reason, a plurality of the semi-finished products are held by the jig 100 separately and therefore, it is possible to reduce the amount of the portions in the plate, which is thrown-away uselessly. More specifically, in a resin molding such as a current transfer-molding, it often happens that the plurality of the semi-finished products 11 formed on a same plate are resin-molded together without being cut from that plate. And in such a manufacturing method, the coils are formed by applying the wire-winding onto rod-shaped cores at the stage before cutting-off the semi-finished products from the plate. In that case, it is necessary to use a special wire-winding machine in which the portion carrying out the wire-winding rotates or the like, and concurrently, it is necessary to widen the space between the adjacent rod-shaped cores. And in that case, uselessly thrown-away portions within the plate will increase. In addition, the cost will become higher because of the cost of the special wire-winding machine.

However, in this embodiment, it is possible, in the stage before the semi-finished product 11 is set onto the jig 100, to form the coil 32 by applying the wire-winding to the rod-shaped core 31. For this reason, it becomes unnecessary to use a special wire-winding machine when forming the coil 32 and therefore, it is possible to reduce the cost. In addition, it becomes unnecessary to widen the space between the adjacent rod-shaped cores 31 and therefore, it becomes unnecessary to increase the plate size uselessly, so that it is possible to reduce the amount of the uselessly thrown-away portions within the plate.

In addition, compared with a case in which each of the semi-finished products 11 is moved or installed individually, it is possible to move the semi-finished products 11 all together in a state in which it is desirable for the semi-finished products 11 to be set onto the jig 100 or it is possible to set the semi-finished products at desired positions of the mold. In this manner, it is possible to make the handling of the semi-finished product 11 easy.

In addition, according to this embodiment, in the sealing-process in which the antenna coil 30 and the base 40 are sealed by the mold, a portion of the lead frame 50 provided in the semi-finished product 11 is sandwiched and held by the mold. Concurrently with this, while setting the base 40 and the antenna coil 30 of the semi-finished product 11 held by the jig 100 in the cavity of the mold, the portion on the Y2 side of the lead frame 50 is arranged on the outside of the cavity of the mold. In another word, the portion on the outside of the portion where the lead frame 50 is sandwiched and held by the mold, and the jig 100 are arranged on the outside of the cavity. For this reason, the jig 100 is positioned on the outside of the cavity of the mold, so that the melted resin will not adhere to the jig 100. In this manner, it becomes possible to use the jig 100 repeatedly without considering the number of times.

Further, in this embodiment, it is preferable for the sealing-process in which the semiconductor substrate 43 is installed to be carried out by using a mold for transfer-molding. In the case of using the mold for transfer-molding, it becomes possible to form a large number of overmold-portions 20 at one time and it becomes possible to improve mass productivity.

Further, in this embodiment, prior to the setting-process in which the plurality of semi-finished products 11 held by the jig 100 are set in a cavity of the mold for transfer-molding, there is carried out an installation-process in which the semiconductor substrate 43 is installed in the resin frame 41 on the base 40. In addition, prior to the setting-process, there is carried out a connection-process in which the terminal ends 32*b* of the coil 32 and the semiconductor substrate 43 are connected electrically, in which these processes are employed after the holding-process of holding the plurality of semi-finished products 11 with the jig 100.

For this reason, in the installation-process, for example, it is possible to install the plurality of semiconductor substrates 43 in the resin frames 41 with a shorter moving distance of a robot arm. In addition, in the connection-process, when the terminal ends 32*b* and the semiconductor substrate 43 are joined, for example, by laser welding, by soldering or the like, a large number of joining portions are arranged in a short distance, so that it becomes possible to efficiently and automatically carry out the joining-process sequentially along with displacement over a short distance. For this reason, in this installation-process and connection-process, it becomes possible to shorten the production time and it becomes possible to improve the production-efficiency.

In addition, in this embodiment, the transportation between the abovementioned installation-process and the connection-process in which the binding portion 421 and the terminal end 32*b* are joined so as to have electrical conductivity by a technique of, for example, laser, soldering or the like and the transportation between the connection-process and the setting-process are carried out by using the jig 100. For this reason, it becomes possible to shorten the production time furthermore and it becomes possible to improve the production-efficiency furthermore.

Further, in this embodiment, there is employed at least one process within the processes of: the wire-winding-process in which the coil 32 is formed by winding the conductive wire 32*a*; the assembling-process in which the semi-finished product 11 is formed by assembling the base 40 and the antenna coil 30; the removing-process in which the resin burr, which occurs at the mold-product during the sealing-process, after the sealing-process; and the cutting-off-process in which the lead frame is cut-off after the removing-process. For this reason, it becomes possible also for those of the wire-winding-process, the assembling-process, the removing-process and the cutting-off-process to be carried out collectively by using the jig 100 and it becomes possible to improve the production-efficiency of the coil component 10.

In addition, in this embodiment, the jig 100 is provided with the lower jig 110 and the upper jig 120, and concurrently, in the holding-process in which the semi-finished product 11 is held, the semi-finished product 11 is sandwiched between the lower jig 110 and the upper jig 120. For this reason, it is possible to hold the semi-finished product 11 easily, and also, it becomes possible to hold the semi-finished product 11 stably compared with a case in which the semi-finished product 11 is held only by the lower jig 110 or the upper jig 120.

Further, in this embodiment, at least after the sealing-process is finished, the residual forming other than the semi-finished product 11 after the formation of the coil product is removed from the jig 100. For this reason, it becomes possible to reuse the jig 100 for the manufacturing of the next coil component 10. Therefore, it becomes possible to produce a large number of coil components 10 by using a small number of jigs 100.

In addition, in this embodiment, the jig includes a holding portion (protruding portions 111, insertion holes 121) which can hold a plurality of semi-finished products 11, each of which includes a base and a coil before forming the coil component, and on the holding portion, the plurality of semi-finished products 11 are held at an interval of a predetermined pitch between each other. In addition, the holding portion holds a portion of the metal-made lead frame 50 which is provided to the semi-finished product 11 and, from the holding portion, the base 40 and the antenna coil 30 are protruded from the jig 100.

For this reason, by plugging-in the protruding portions 111 which form a portion of the holding portion into the attachment holes 511 of the lead frame 50 and by inserting those protruding portions 111 into the insertion holes 121 which form a portion of the holding portion, it is possible to prevent the semi-finished products 11 from dropping out from the jig 100 and it becomes possible to securely hold the semi-finished products 11.

Modified Example

As described above, there was described one embodiment of the present invention, but it is possible for the present invention to employ various kinds of modifications other than that configuration. Hereinafter, some example modifications will be described.

In the above-mentioned embodiment, the explanation thereof is carried out with regard to a configuration in which the jig 100 uses the lower jig 110 provided with the protruding portions 111 and the upper jig 120 provided with the insertion holes 121. However, the jig is not limited by such a configuration which uses the lower jig 110 and the upper jig 120. For example, it is allowed to use such a configuration in which there exist no insertion holes 121, which are a portion of the holding portion, on the side of the upper jig 120 and there exist shorter protruding portions 111 as the holding portion on the side of the lower jig 110. In that case, the end surfaces of the protruding portions 111 abut against the surface of the upper jig 120, but caused by a mechanism that the protruding portions 111 are inserted into the attachment holes 511, it becomes possible to prevent the semi-finished product 11 from being disengaged from the jig 100 satisfactorily.

In addition, in the above-mentioned embodiment, the lower jig 110 and the upper jig 120 are separately independent. However, it is allowed for the lower jig and the upper jig to be provided integrally. For such a configuration, it is possible to cite such a shape as, for example, a fire-tongs shape having a single-piece plate shape. It should be noted that in case of employing the fire-tongs shape, it is preferable to employ a mechanism in which a bias force is always applied at the boundary portion between the lower-jig side and the upper-jig side toward a direction for being closed. For this reason, it is preferable for the above-mentioned boundary portion to be provided, for example, in an arc shape or in a ring shape in which the diameter of the shape is large to a certain degree.

In addition, it is allowed for the jig to use a constitution in which the lower jig and the upper jig are fixed firmly, for example, by using a magnet. In addition, it is allowed for the jig to employ a constitution in which only one of the lower jig and the upper jig is used. In this case, it is allowed to employ a constitution in which the semi-finished products 11 are fixed by an interference-fit or the like with respect to the jig, it is also allowed to employ an absorption system such as of a sucker type and in addition, it is also allowed to employ a constitution in which the semi-finished products 11 are held by adhesion or bonding.

In addition, in the above-mentioned embodiment, there was explained a case in which protruding portions 111 and insertion holes 121 were used as the holding portion. However, it is possible for the holding portion to utilize various kinds of other constitutions. For example, it is allowed for the holding portion to employ a constitution in which there is provided a hook-shaped portion by which the plug-in is easy, but the dropout is difficult by being provided with a taper. In addition, it is allowed to employ a configuration in which there is provided a presser which rotates centered on a fulcrum with respect to the lower jig or the upper jig and that presser is used for the holding portion.

In addition, in the above-mentioned embodiment, unless a trouble occurs for the manufacturing of the coil component 10, it is allowed to omit at least one of the processes from the first-process to the thirteenth-process and it is also allowed to exchange the orders of those processes. In addition, if the semi-finished product 11 is held onto the jig 100 in any one of the processes before the sealing-process of the eleventh-process, it is allowed for the holding of the semi-finished product 11 onto that jig 100 thereof to be carried out in any one of the processes.

Having described preferred embodiments of the invention with reference to the accompanying drawings, it is to be understood that the invention is not limited to those precise embodiments and that various changes and modifications could be effected therein by one skilled in the art without departing from the scope of the invention as defined in the appended claims.

What is claimed is:

1. A manufacturing method of a coil component comprising steps of:

providing a jig including a holding portion, the holding portion being configured to hold a plurality of semi-finished products;

holding the plurality of semi-finished products by the holding portion of the jig, each of the plurality of semi-finished products having a base and a coil;

providing a mold having a cavity therein, the cavity being configured to seal part of the base and part of the coil of each of the plurality of semi-finished products;

placing the plurality of semi-finished products held by the jig in the mold so that the plurality of semi-finished products are set at a setting position of the jig in the mold; and sealing at least the part of the base and at least the part of the coil with a resin by filling the resin into the cavity of the mold, wherein the jig further includes a lower jig and an upper jig, and wherein in the placing, each of the plurality of semi-finished products is sandwiched between the lower jig and the upper jig concurrently in the holding of the plurality of semi-finished products.

2. The manufacturing method of a coil component according to claim 1, wherein during the sealing, part of a metal lead frame provided in each of the plurality of semi-finished products is held by the mold, and wherein during the placing, another part of the metal lead frame on an outer side of an area in which the metal lead frame is held by the mold, and the jig are arranged outside the cavity of the mold.

3. The manufacturing method of a coil component according to claim 2, wherein the mold is a transfer-molding mold.

4. The manufacturing method of a coil component according to claim 2, further comprising:

installing a semiconductor substrate at a resin frame of each of the bases of the plurality of semi-finished products prior to the placing; and electrically connecting terminal-ends of each of the coils and each of the semiconductor substrates of the plurality of semi-finished products prior to the placing and after the installing, wherein the installing and the connecting are performed after the holding of the plurality of semi-finished products by the holding portion of the jig.

5. The manufacturing method of a coil component according to claim 4, further comprising:

a first transportation of the plurality of semi-finished products from the installing to the connecting using the jig; and a second transportation of the plurality of semi-finished products from the connecting to the placing using the jig.

6. The manufacturing method of a coil component according to claim 5, wherein, after the sealing is completed, a residual component of each of the plurality of semi-finished products is removed from the plurality of semi-finished products held by the jig, and the residual component corresponds to an un-necessary part of the coil component.

7. The manufacturing method of a coil component according to claim 4, wherein, after the sealing is completed, a residual component of each of the plurality of semi-finished products is removed from the plurality of semi-finished products held by the jig, and the residual component corresponds to an un-necessary part of the coil component.

8. The manufacturing method of a coil component according to claim 2, further comprising at least one of:

winding a conductive wire so as to form the coil;

assembling the base and the coil so as to form each of the plurality of semi-finished products;

removing a resin burr, which is formed on a molded product during the sealing, after the sealing; and cutting-off each of the metal lead frames of the molded product after the removing of the resin burr.

9. The manufacturing method of a coil component according to claim 8, wherein, after the sealing is completed, a residual component of each of the plurality of semi-finished products is removed from the plurality of semi-finished products held by the jig, and the residual component corresponds to an un-necessary part of the coil component.

10. The manufacturing method of a coil component according to claim 2, wherein, after the sealing is completed, a residual component of each of the plurality of semi-finished products is removed from the plurality of semi-finished products held by the jig, and the residual component corresponds to an un-necessary part of the coil component.

11. The manufacturing method of a coil component according to claim 1, wherein the mold is a transfer-molding mold.

12. The manufacturing method of a coil component according to claim 11, further comprising:

installing a semiconductor substrate at a resin frame of each of the bases of the plurality of semi-finished products prior to the placing; and electrically connecting terminal-ends of each of the coils and each of the semiconductor substrates of the plurality of semi-finished products prior to the placing and after the installing, wherein the installing and the connecting are performed after the holding of the plurality of semi-finished products by the holding portion of the jig.

13. The manufacturing method of a coil component according to claim 12, further comprising:

a first transportation of the plurality of semi-finished products from the installing to the connecting using the jig; and a second transportation of the plurality of semi-finished products from the connecting to the placing using the jig.

14. The manufacturing method of a coil component according to claim 13, wherein, after the sealing is completed, a residual component of each of the plurality of semi-finished products is removed from the plurality of semi-finished products held by the jig, and the residual component corresponds to an un-necessary part of the coil component.

15. The manufacturing method of a coil component according to claim 12, wherein, after the sealing is completed, a residual component of each of the plurality of semi-finished products is removed from the plurality of semi-finished products held by the jig, and the residual component corresponds to an un-necessary part of the coil component.

16. The manufacturing method of a coil component according to claim 1, further comprising:

installing a semiconductor substrate at a resin frame of each of the bases of the plurality of semi-finished products prior to the placing; and electrically connecting terminal-ends of each of the coils and each of the semiconductor substrates of the plurality of semi-finished products prior to the placing and after the installing, wherein the installing and the connecting are performed after the holding of the plurality of semi-finished products by the holding portion of the jig.

17. The manufacturing method of a coil component according to claim 16, further comprising:

a first transportation of the plurality of semi-finished products from the installing to the connecting using the jig; and a second transportation of the plurality of semi-finished products from the connecting to the placing using the jig.

18. The manufacturing method of a coil component according to claim 17, wherein, after the sealing is completed, a residual component of each of the plurality of semi-finished products is removed from the plurality of semi-finished products held by the jig, and the residual component corresponds to an un-necessary part of the coil component.

19. The manufacturing method of a coil component according to claim 16, wherein, after the sealing is completed, a residual component of each of the plurality of semi-finished products is removed from the plurality of semi-finished products held by the jig, and the residual component corresponds to an un-necessary part of the coil component.

20. The manufacturing method of a coil component according to claim 1, wherein, after the sealing is completed, a residual component of each of the plurality of semi-finished products is removed from the plurality of semi-finished products held by the jig, and the residual component corresponds to an un-necessary part of the coil component.

* * * * *